US006299467B1

(12) United States Patent
Chien

(10) Patent No.: US 6,299,467 B1
(45) Date of Patent: Oct. 9, 2001

(54) ELECTRICAL CONNECTOR

(75) Inventor: Min-Lung Chien, Taipei Hsien (TW)

(73) Assignee: Advanced Connecteck Inc., Hsintien (TW)

( * ) Notice: Subject to any disclaimer, the term of this patent is extended or adjusted under 35 U.S.C. 154(b) by 0 days.

(21) Appl. No.: 09/551,263

(22) Filed: Apr. 18, 2000

(51) Int. Cl.[7] ..... H01R 29/00
(52) U.S. Cl. ..... 439/188; 200/51.09
(58) Field of Search ..... 439/188, 189, 439/488, 489, 374; 379/446, 455, 454; 200/51.09, 51.1

(56) References Cited

U.S. PATENT DOCUMENTS 5,260,998 * 11/1993 Takagi ..... 379/446
5,267,868 * 12/1993 Wolff, Jr. ..... 200/51.1
5,711,013 * 1/1998 Collett et al. ..... 379/446
5,726,383 * 3/1998 Geller et al. ..... 379/455
5,888,087 * 5/1999 Hanson et al. ..... 439/374
5,956,399 * 9/1999 Whitley et al. ..... 379/446
6,030,240 * 2/2000 Duff ..... 439/188
6,058,185 * 5/2000 Alanara ..... 379/446
6,129,582 * 10/2000 Wilhite et al. ..... 439/489
6,142,803 * 11/2000 Bozzer et al. ..... 439/188

* cited by examiner

*Primary Examiner*—Paula Bradley
*Assistant Examiner*—Shanetta D. Ore
(74) *Attorney, Agent, or Firm*—Merchant & Gould P.C.

(57) ABSTRACT

An electrical connector includes an insulated housing having a top wall formed with a top opening, a first terminal having a first solder tail projecting outwardly from the housing and a first contact part in contact with the housing, and a second terminal having a second solder tail projecting outwardly from the housing and a spring arm connected to and extending above the second solder tail. The spring arm has a second contact part disposed below and aligned with the first contact part, and a U-shaped bent portion projecting into the top opening. The second contact part is movable between a first position, in which the second contact part is urged by the spring arm to make contact with the first contact part, and a second position, in which the second contact part is moved away from the first contact part when the U-shaped bent portion is pressed downwardly.

17 Claims, 8 Drawing Sheets

ELECTRICAL CONNECTOR

BACKGROUND OF THE INVENTION

1. Field of the invention

This invention relates to an electrical connector, more particular to an electrical connector which serves as an ON/OFF switch for a circuit device, such as a mobile phone.

2. Description of the related art

A mobile phone is normally provided with a cover for protecting a key-input panel thereof, and an electrical connector serving as an ON/OFF switch and engaging releasably the cover to deactivate the mobile phone when the cover covers the key-input panel.

SUMMARY OF THE INVENTION

The object of the present invention is to provide an electrical connector of the aforementioned type and having a relatively simple construction.

According to the present invention, an electrical connector comprises: an insulated inner housing having a top wall formed with a top opening; a first terminal disposed below the top wall and mounted securely in the insulated inner housing, the first terminal having a first solder tail projecting outwardly from the insulated inner housing and adapted to be connected to a circuit device, and a first contact part connected to the first solder tail; and a second terminal disposed below the top wall and mounted securely in the insulated inner housing, the second terminal having a second solder tail projecting outwardly from the insulated inner housing and adapted to be connected to the circuit device, and a spring arm connected to and extending above the second solder tail within the insulated inner housing and movable upward and downward relative to the second solder tail, the spring arm having a second contact part disposed below and aligned with the first contact part, and a U-shaped bent portion extending upwardly from the second contact part and projecting into the top opening, the second contact part being movable between a first position, in which the second contact part is urged by the spring arm to make contact with the first contact part, and a second position, in which the second contact part is moved away from the first contact part when the U-shaped bent portion is pressed downwardly.

BRIEF DESCRIPTION OF THE DRAWINGS

In drawings which illustrate an embodiment of the invention.

DETAILED DESCRIPTION OF THE PREFERRED EMBODIMENT

Figure 1:
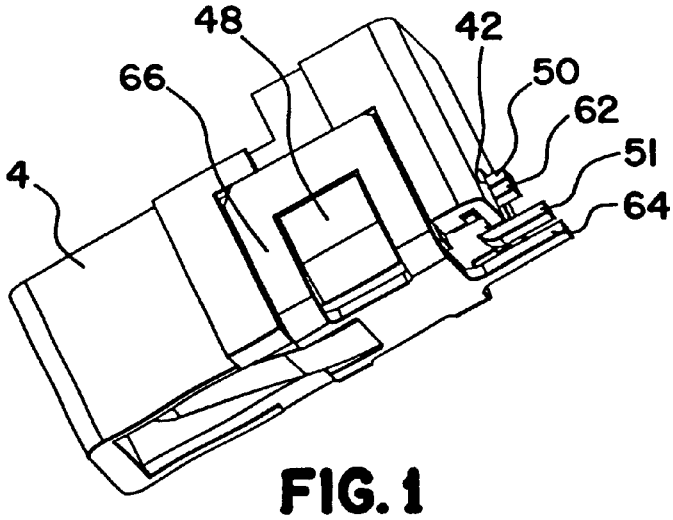
FIG. 1 is a perspective view of an electrical connector embodying this invention viewed from a different angle.
Figure 2:
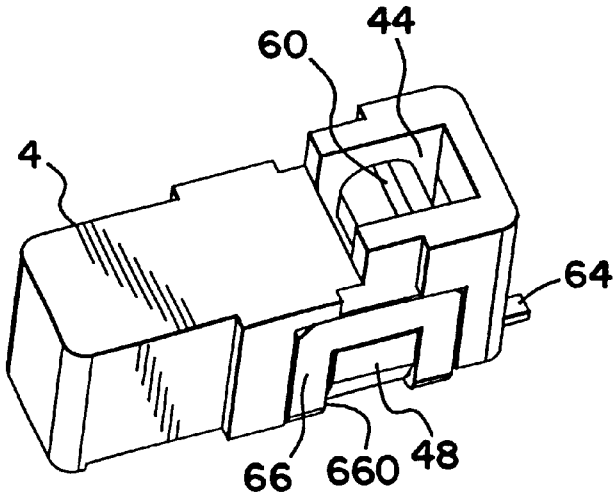
FIG. 2 is another perspective view of the electrical connector of FIG. 1.
Figure 3:
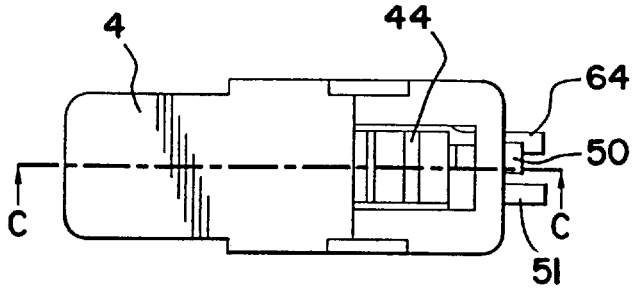
FIG. 3 is a top view of the electrical connector of FIG. 1.
Figure 4:
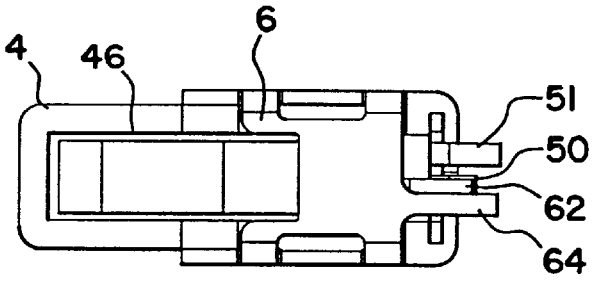
FIG. 4 is a bottom view of the electrical connector of FIG. 1.
Figure 5:
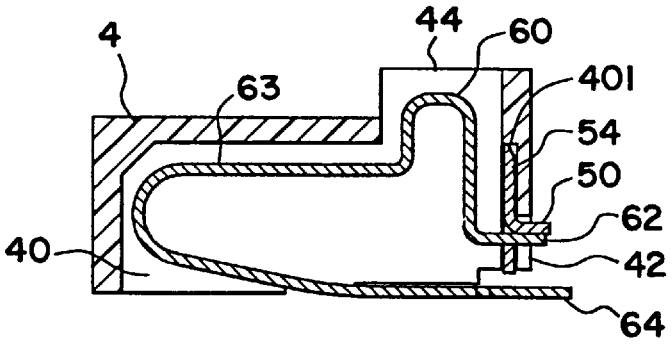
FIG. 5 is a cross-sectional side view taken along line C—C of FIG. 3.
Figure 6:
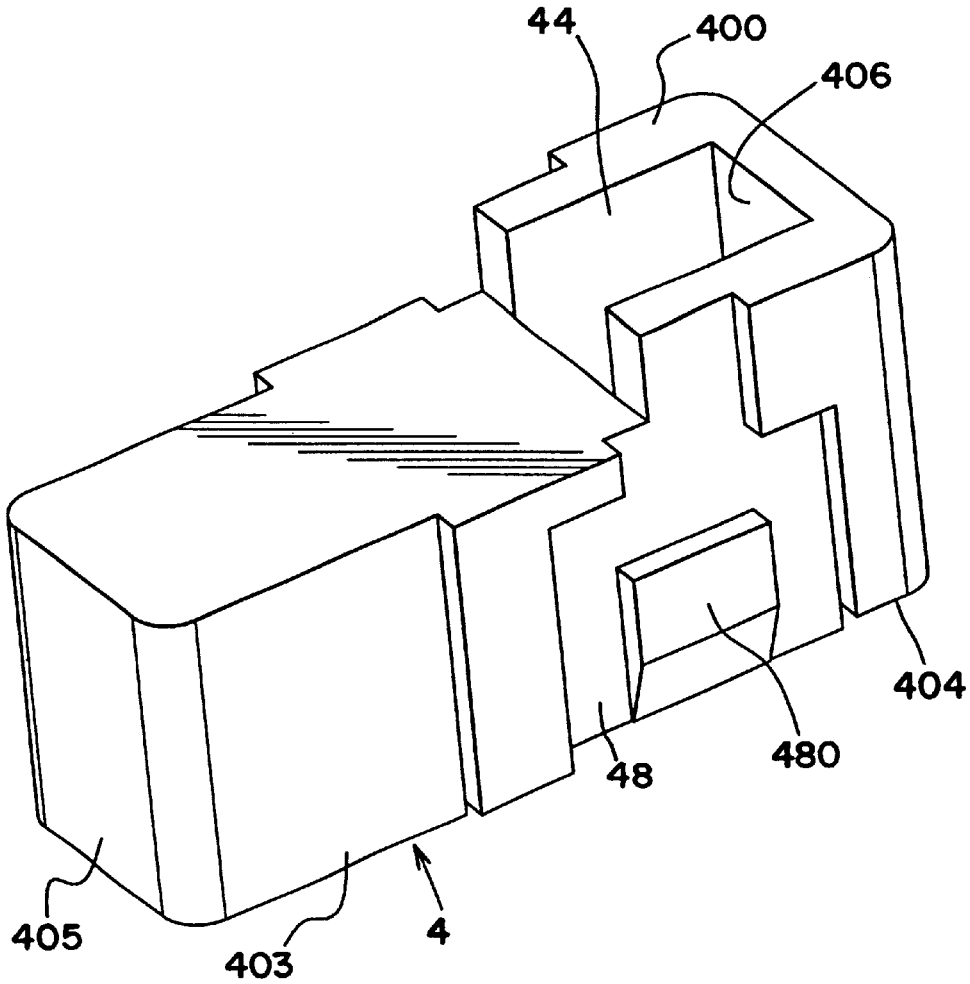
FIG. 6 is a perspective view of an insulated inner housing of the electrical connector of FIG. 1.
Figure 7:
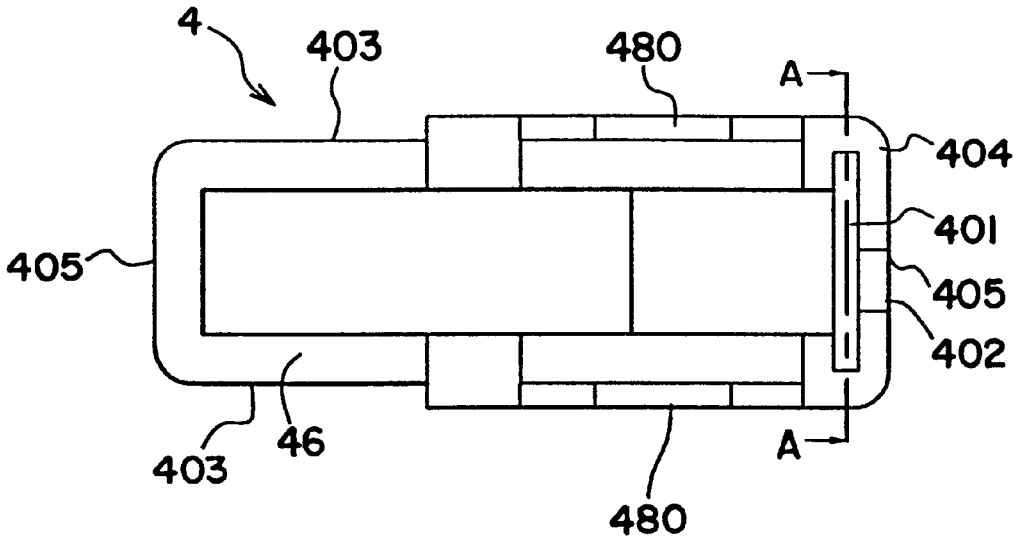
FIG. 7 is a bottom view of the insulated inner housing of FIG. 6.
Figure 8:
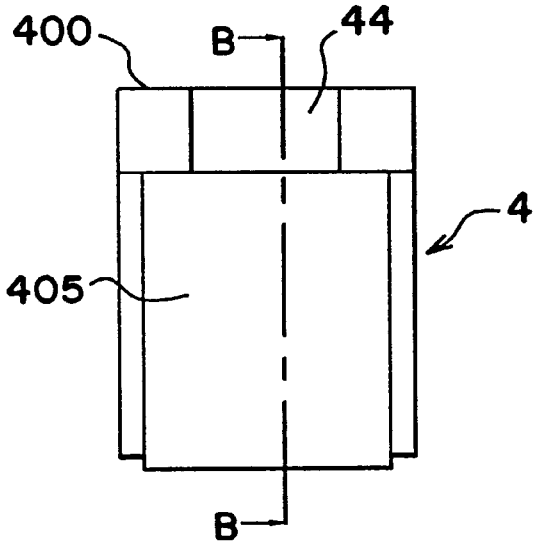
FIG. 8 is a side view of the insulated inner housing of FIG. 6.
Figure 9:
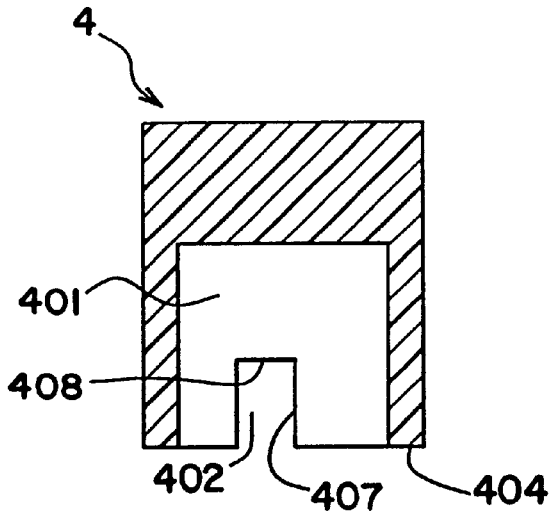
FIG. 9 is a cross-sectional side view taken along line A—A of FIG. 7.
Figure 10:
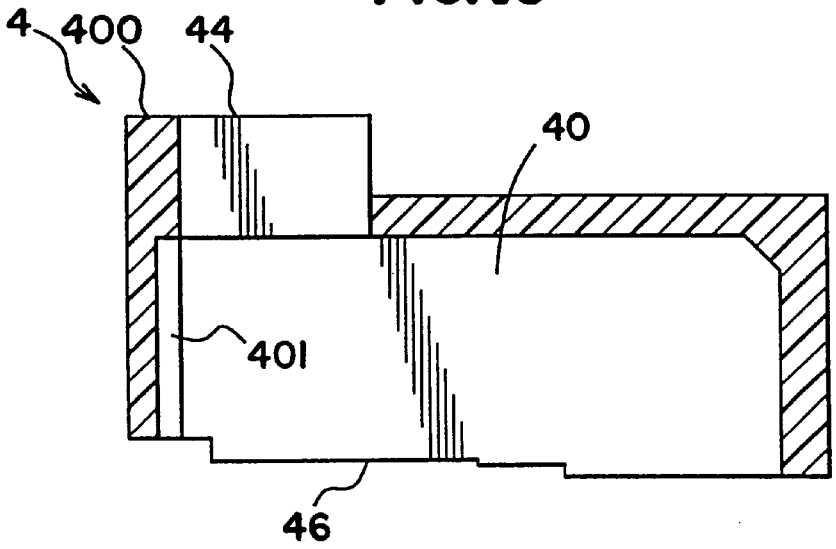
FIG. 10 is another cross-sectional side view taken along line B—B of FIG. 8.

FIGS. 1 to 5 illustrate an electrical connector embodying this invention. The electrical connector includes an insulated inner housing 4 confining an inner space 40, a first terminal 5 mounted in the inner space 40, and a second terminal 6 mounted in the inner space 40 and connected releasably to the first terminal 5.

Referring now to FIGS. 6 to 10, in combination with FIGS. 1 to 5, the insulated inner housing 4 has a top wall 400 formed with a top opening 44 that permits access to the inner space 40, a bottom open end 46, two opposite side walls 403, and two opposite end walls 405 interconnecting the side walls 403. Each of the side walls 403 is formed with a first recess 48. A tongue 480 projects outwardly from each side wall 403 within the respective first recess 48. One of the end walls 405 has an inner face 406 which is indented to form a second recess 401, a bottom end face 404, and a bottom notch 402 defined by an inverted U-shaped notch edge 407 that extends upwardly from the bottom end face 404. The notch edge 407 has a horizontally extending top edge portion 408 that faces downwardly.

Figure 11:
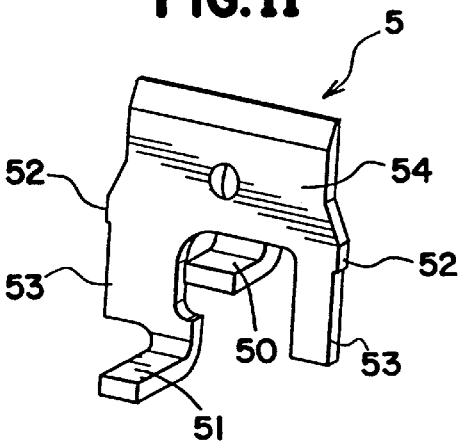
FIG. 11 is a perspective view of a first terminal of the electrical connector of FIG. 1.
Figure 12:
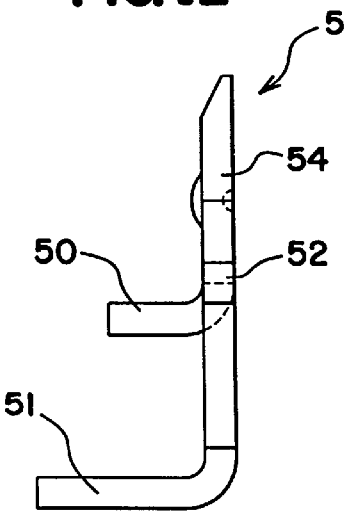
FIG. 12 is a side view of the first terminal of FIG. 11.
Figure 13:
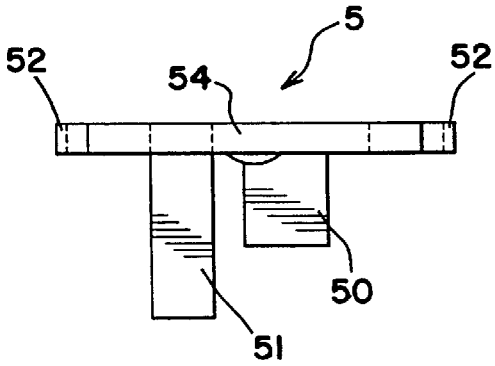
FIG. 13 is a top view of the first terminal of FIG. 11.

Referring now to FIGS. 11 to 13, in combination with FIGS. 1 to 10, the first terminal 5 has a vertically extending portion 54 received in the second recess 401. Two opposite engaging parts 52 project laterally and oppositely from two opposite sides of the vertically extending portion 54 for engaging said one of the end walls 405 so that the first terminal 5 can be held securely in the second recess 401. Two opposite and spaced apart legs 53 extend downwardly from a bottom end of the vertically extending portion 54. A first solder tail 51 projects horizontally from a bottom end of one of the legs 53 through the bottom notch 402 adjacent to the bottom open end 46 of the inner housing 4. A first contact part 50 is disposed between the legs 53 and between the top edge portion 408 and the first solder tail 51, extends horizontally from the bottom end of the vertically extending portion 54 through the bottom notch 402, and is in contact with the top edge portion 408.

Figure 14:
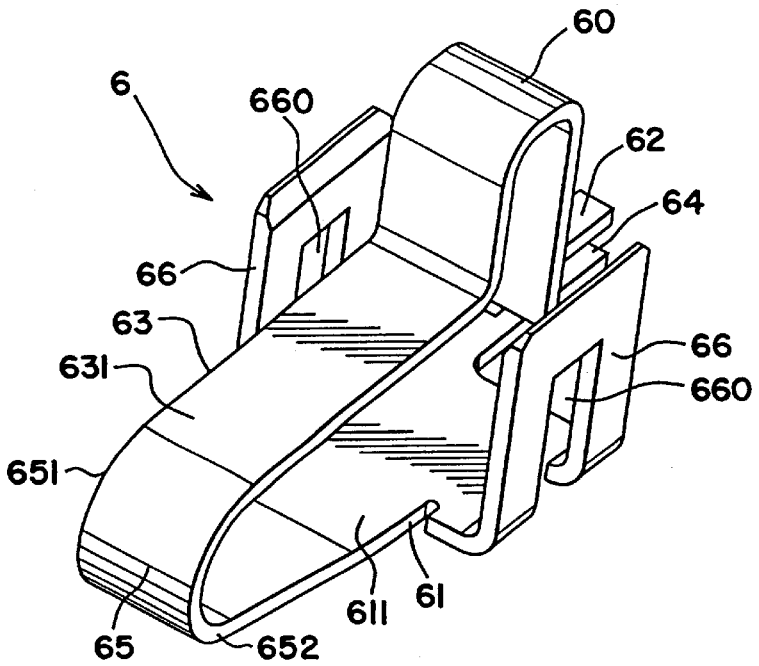
FIG. 14 is a perspective view of a second terminal of the electrical connector of FIG. 1.
Figure 15:
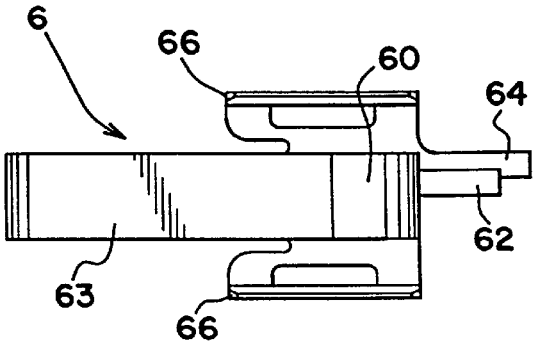
FIG. 15 is a top view of the second terminal of FIG. 14.
Figure 16:
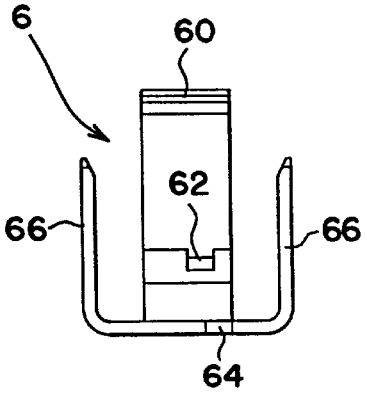
FIG. 16 is a side view of the second terminal of FIG. 14.

Referring now to FIGS. 14 to 16, in combination with FIGS. 1 to 13, the second terminal 6 has a U-shaped folded portion 65 which includes opposite upper and lower arms 651, 652 extending in a direction toward said one of the end walls 405, a holding portion 61 which includes a first horizontally extending portion 611 that extends from the lower arm 652 along the bottom open end 46 of the insulated inner housing 4 in a direction toward said one of the end walls 405, and a spring arm 63 which includes a second horizontally extending portion 631 that extends from the upper arm 651 above the holding portion 61 in a direction substantially parallel to the first horizontally extending portion 611. An inverted U-shaped bent portion 60, which is disposed opposite to the upper arm 651, extends upwardly from one end of the second horizontally extending portion 631 into the top opening 44. A second contact part 62, which is disposed opposite to the second horizontally extending portion 631, extends horizontally from one end of the inverted U-shaped bent portion 60 through the bottom notch 402 and is disposed below and is aligned with the first contact part 50. A second solder tail 64, which is disposed opposite to the lower arm 652, extends horizontally below the second contact part 62 from one end of the first horizontally extending portion 611 through the bottom notch 402. The spring arm 63 is turnable upward and downward about the folded portion 65 so that the second contact part 62 is movable upwardly and downwardly between a first position, in which the second contact part 62 is urged by the spring arm 63 to make contact with the first contact part 50, and a second position, in which the second contact part 62 is moved away from the first contact part 50 when the inverted U-shaped bent portion 60 is pressed downwardly. Since the first contact part 50 is in contact with the horizontally extending top edge portion 408, the second contact part 62 is able to abut tightly against the first contact part 50 when in the first position. Two opposite holding arms 66 project upwardly and respectively from two opposite sides of the first horizontally extending portion 611 into the first recesses 48, and provide a clamping force for clamping tightly the side walls 403 of the insulated inner housing 4. Each holding arm 66 has a groove 660 receiving and engaging the respective tongue 480 for limiting lateral movement of the second terminal 6.

Figure 17:
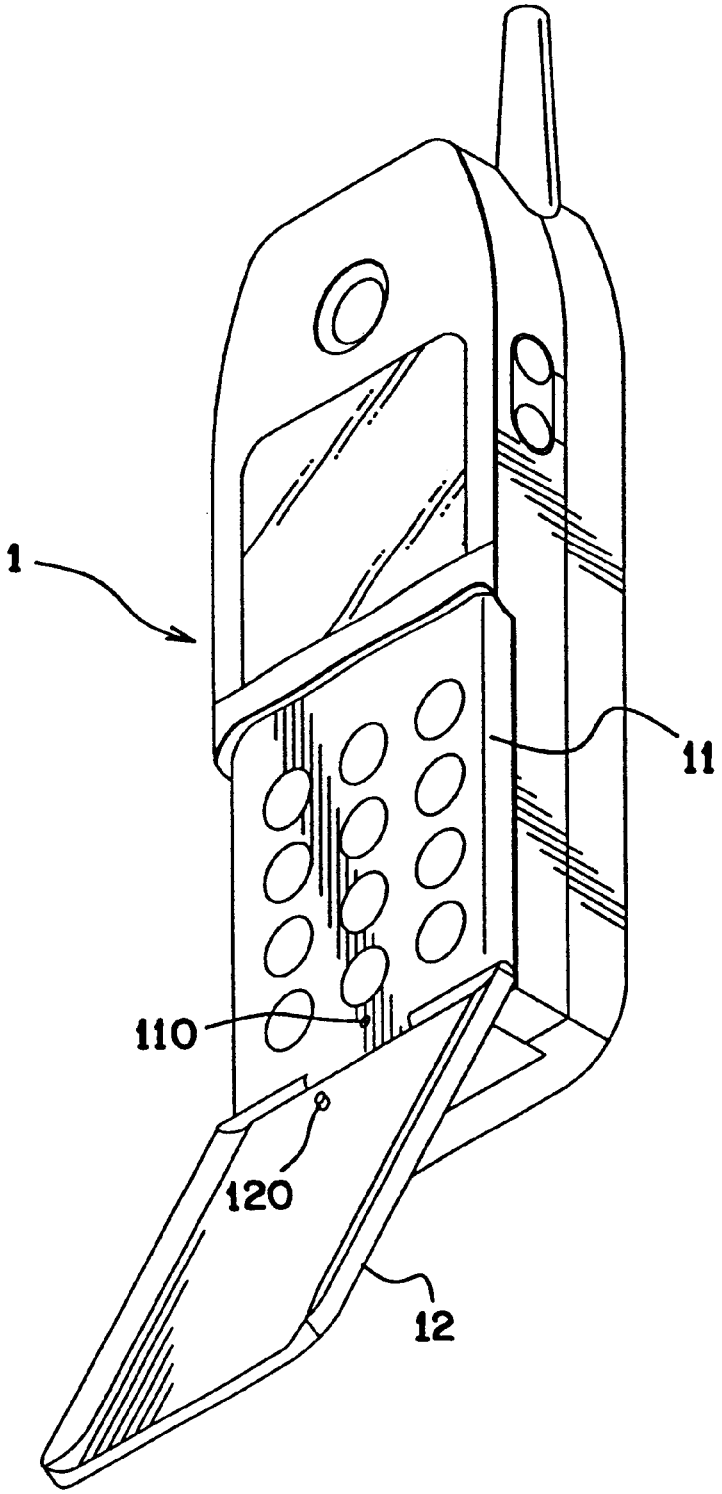
FIG. 17 is a perspective view of an electrical appliance in the form a mobile phone having the electrical connector of FIG. 1 mounted therein.

FIG. 17 illustrates an electrical appliance in the form of a mobile phone 1 which incorporates with the aforesaid electrical connector shown in FIGS. 1 to 5. The mobile phone 1 includes an outer housing which has a key-input front panel 11, a circuit device (not shown) mounted in the outer housing and connected to the first and second solder tails 51, 64, and a cover 12 mounted pivotally on a bottom end of the key-input front panel 11 for covering openably the key-input front panel 11. A through-hole 110 is formed in the key-input front panel 11. A protrusion 120 projects outwardly from the cover 12 for projecting movably into the top opening 44 via the through-hole 10 to press the inverted U-shaped bent portion 60 downwardly and to move the second contact part 62 to the second position in order to deactivate the circuit device when the cover 12 covers the key-input front panel 11. When the cover 12 is opened, the spring arm 63 urges the second contact part 62 to move to the first position, thereby enabling activation of the circuit device. 12 for projecting movably into the top opening 44 via the through-hole 110 to press the inverted U-shaped bent portion 60 downwardly and to move the second contact part 62 to the second position in order to deactivate the circuit device when the cover 12 covers the key-input front panel 11. When the cover 12 is opened, the spring arm 63 urges the second contact part 62 to move to the first position, thereby enabling activation of the circuit device.

With the invention thus explained, it is apparent that various modifications and variations can be made without departing from the spirit of the present invention. It is therefore intended that the invention be limited only as recited in the appended claims.

I claim:

1. An electrical connector, comprising:

an insulated inner housing having a top wall formed with a top opening;

a first terminal disposed below said top wall and mounted in said insulated inner housing, said first terminal having a first solder tail projecting outwardly from said insulated inner housing, and a first contact part connected to said first solder tail; and a second terminal disposed below said top wall and mounted in said insulated inner housing, said second terminal having a second solder tail projecting outwardly from said insulated inner housing, and a spring arm connected to and extending above said second solder tail within said insulated inner housing and movable upward and downward relative to said second solder tail, said spring arm having a second contact part disposed below and aligned with said first contact part, and a U-shaped bent portion extending upwardly from said second contact part and projecting into said top opening, said second contact part being movable between a first position, wherein, said second contact part is urged by said spring arm in contact with said first contact part, and a second position, in which said second contact part is away from said first contact part when said U-shaped bent portion is pressed downwardly, wherein said second terminal has a U-shaped folded portion disposed between said spring arm and said second solder tail, said U-shaped folded portion having a lower arm connected to said second solder tail, and an upper arm, said spring arm extending from said upper arm of said U-shaped folded portion and being turnable upward and downward about said U-shaped folded portion.

2. The electrical connector according to claim 1, wherein said second terminal has a holding portion interconnecting said lower arm of said U-shaped folded portion and said second solder tail for engaging said insulated inner housing so that said second terminal is secured in said insulated inner housing.

3. The electrical connector of claim 2, wherein said holding portion includes a first horizontally extending portion extending from said lower arm of said U-shaped folded portion to said second solder tail below said spring arm, and two holding arms projecting upwardly from two opposite sides of said first horizontally extending portion, respectively, said insulated inner housing having two opposite side walls, each of which is indented to form a first recess, said holding arms extending respectively into said first recesses of said side walls so as to clamp said insulated inner housing.

4. The electrical connector of claim 3, wherein each of said holding arms has a groove formed therein, each of said side walls having a tongue which is disposed within the respective one of said first recesses and which projects outwardly therefrom and into said groove of the respective one of said holding arms for engagement therewith.

5. The electrical connector of claim 4, wherein said spring arm has a second horizontally extending portion which extends from said upper arm of said U-shaped folded portion in a direction toward said second solder tail and substantially parallel to said first horizontally extending portion, said U-shaped bent portion projecting upwardly from said second horizontally extending portion into said top opening, said second contact part extending horizontally from one end of said U-shaped bent portion through said insulated inner housing.

6. The electrical connector of claim 4, wherein said insulated inner housing has two opposite end walls interconnecting said side walls, one of said end walls having a second recess formed therein, said first terminal having a vertically extending portion received in said second recess, and two opposite engaging parts projecting laterally and respectively from two opposite sides of said vertically extending portion for engaging said one of said end walls.

7. The electrical connector of claim 6, wherein said one of said end walls has a bottom end face and a bottom notch defined by a U-shaped notch edge, said U-shaped notch edge extending upwardly from said bottom end portion, said first contact part extending horizontally from a bottom end of said vertical extending portion through said bottom notch and in contact with said horizontally extending top edge portion so that said second contact part abuts against said first contact part.

8. The electrical connector of claim 7, wherein said first terminal has two opposite legs projecting downwardly from said bottom end of said vertical extending portion, said first contact part is disposed between said legs, said first solder tail projecting horizontally from a bottom end of one of said legs.

9. An electrical appliance, comprising:

an outer housing having a key-input front panel with a through-hole formed therein;

a cover mounted pivotally on said outer housing for covering openably said key-input front panel; and an electrical connector mounted in said outer housing and including:

an insulated inner housing having a top wall formed with a top opening;

a first terminal disposed below said top wall and mounted securely in said insulated inner housing, said first terminal having a first solder tail projecting outwardly from said insulated inner housing, and a first contact part connected to said first solder tail; and a second terminal disposed below said top wall and mounted securely in said insulated inner housing, said second terminal having a second solder tail projecting outwardly from said insulated inner housing, and a spring arm connected to and extending above said second solder tail within said insulated inner housing and movable upward and downward relative to said second solder tail, said spring arm having a second contact part disposed below and aligned with said first contact part, and a U-shaped bent portion extending upwardly from said second contact part and projecting into said top opening, said second contact part being movable between a first position, in which said second contact part is urged by said spring arm to make contact with said first contact part, and a second position, in which said second contact part is moved away from said first contact part when said U-shaped bent portion is pressed downwardly;

said cover having a protrusion which projects into said top opening via said through-hole to press said U-shaped bent portion and to move said second contact part to said second position when said cover covers said key-input front panel.

10. The electrical appliance of claim 9, wherein said second terminal further has a U-shaped folded portion disposed between said spring arm and said second solder tail, said U-shaped folded portion having a lower arm connected to said second solder tail, and an upper arm, said spring arm extending from said upper arm of said U-shaped folded portion and being turnable upward and downward about said U-shaped folded portion.

11. The electrical appliance of claim 10, wherein said second terminal further has a holding portion interconnecting said lower arm of said U-shaped folded portion and said second solder tail for engaging said insulated inner housing so that said second terminal can be held securely in said insulated inner housing.

12. The electrical appliance of claim 11, wherein said holding portion includes a first horizontally extending portion extending from said lower arm of said U-shaped folded portion to said second solder tail below said spring arm, and two holding arms projecting respectively and upwardly from two opposite sides of said first horizontally extending portion, said insulated inner housing having two opposite side walls, each of which is indented to form a first recess, said holding arms extending respectively into said first recesses of said side walls so as to clamp tightly said insulated inner housing.

13. The electrical appliance of claim 12, wherein each of said holding arms has a groove formed therein, each of said side walls having a tongue which is disposed within the respective one of said first recesses and which projects outwardly therefrom and into said groove of the respective one of said holding arms for engagement therewith.

14. The electrical appliance of claim 13, wherein said spring arm has a second horizontally extending portion which extends from said upper arm of said U-shaped folded portion in a direction toward said second solder tail and substantially parallel to said first horizontally extending portion, said U-shaped bent portion projecting upwardly from said second horizontally extending portion into said top opening, said second contact part extending horizontally from one end of said U-shaped bent portion through said insulated inner housing.

15. The electrical appliance of claim 14, wherein said insulated inner housing further has two opposite end walls interconnecting said side walls, one of said end walls having a second recess formed therein, said first terminal having a vertically extending portion received in said second recess, and two opposite engaging parts projecting laterally and respectively from two opposite sides of said vertically extending portion for engaging said one of said end walls.

16. The electrical appliance of claim 15, wherein said one of said end walls has a bottom end face and a bottom notch defined by a U-shaped notch edge, said U-shaped notch edge extending upwardly from said bottom end face and having a horizontally extending top edge portion, said first contact part extending horizontally from a bottom end of said vertical extending portion through said bottom notch and being in contact with said horizontally extending top edge portion so that said second contact part is able to abut tightly against said first contact part.

17. The electrical appliance of claim 16, wherein said first terminal further has two opposite legs projecting downwardly from said bottom end of said vertical extending portion, said first contact part being disposed between said legs, said first solder tail projecting horizontally from a bottom end of one of said legs.

* * * * *

UNITED STATES PATENT AND TRADEMARK OFFICE

CERTIFICATE OF CORRECTION

PATENT NO. : 6,299,467 B1
DATED : October 9, 2001
INVENTOR(S) : Chien

It is certified that error appears in the above-identified patent and that said Letters Patent is hereby corrected as shown below:

Title page,
Item [73], Assignee, "Connecteck" should read -- Connectek --

Signed and Sealed this

Twenty-second Day of October, 2002

*Attest:*

*Attesting Officer*

JAMES E. ROGAN
*Director of the United States Patent and Trademark Office*